US008939332B2

(12) United States Patent
Elliott

(10) Patent No.: US 8,939,332 B2
(45) Date of Patent: Jan. 27, 2015

(54) DEVICE FOR CONDITIONING A GLOVE AND METHODS OF FORMING AND USING THE SAME

(76) Inventor: Christopher Elliott, Maryville, TN (US)

( * ) Notice: Subject to any disclaimer, the term of this patent is extended or adjusted under 35 U.S.C. 154(b) by 98 days.

(21) Appl. No.: 13/486,521

(22) Filed: Jun. 1, 2012

(65) Prior Publication Data

US 2013/0320050 A1 Dec. 5, 2013

(51) Int. Cl.
*A41D 1/00* (2006.01)

(52) U.S. Cl.
USPC ..... 223/78

(58) Field of Classification Search
CPC .... A63B 71/14; A63B 71/141; A63B 71/143; A63B 47/00; D06C 3/08; A47G 25/92
USPC ..... 223/66, 78, 84; 206/278, 315.9; 2/19
See application file for complete search history.

(56) References Cited

U.S. PATENT DOCUMENTS 4,065,813 A 1/1978 Hudson
4,418,849 A 12/1983 Santa
4,592,549 A 6/1986 Ryan
4,691,824 A 9/1987 Schindler
4,765,519 A 8/1988 Groves
4,883,170 A 11/1989 Wright
4,958,729 A 9/1990 Wright
5,000,317 A 3/1991 Cich
5,265,871 A * 11/1993 Hanley ..... 473/415
5,267,677 A 12/1993 Nash
5,456,390 A * 10/1995 McFarland ..... 223/78
5,672,127 A * 9/1997 Danz ..... 473/458
5,758,805 A 6/1998 Dunn
5,810,215 A 9/1998 Plymell
6,430,746 B1 8/2002 Watson

FOREIGN PATENT DOCUMENTS

JP 2007202711 A * 8/2007

* cited by examiner

*Primary Examiner* — Nathan Durham
(74) *Attorney, Agent, or Firm* — Pitts & Lake, P.C.

(57) ABSTRACT

A device to aid in conditioning a baseball glove, namely in the formation and/or maintenance of a baseball pocket, typically includes one or more balls, two or more looped straps, and a means for coupling the two or more looped straps to the one or more balls. The one or more balls are placed in a baseball glove proximate a desired location for the baseball pocket, and the two or more looped straps are fed through a slot of the glove interposing an interior of the glove and an exterior of the glove and wrapped around the exterior of the glove to force the ball deeper into the desired location for the baseball pocket and secure the glove around the ball.

6 Claims, 7 Drawing Sheets

DEVICE FOR CONDITIONING A GLOVE AND METHODS OF FORMING AND USING THE SAME

CROSS-REFERENCE TO RELATED APPLICATIONS

N/A

FIELD OF INVENTION

The present inventive concept relates generally to baseball, and more particular to a device to aid in conditioning a baseball glove, namely in the formation and/or maintenance of a baseball pocket. Additionally, the present general inventive concept also includes methods of forming and using the device.

BACKGROUND

Baseball and softball gloves, or mitts, are designed to be worn by players to aid in the catching of baseballs and/or softballs. Due to the often high velocities at which the balls may travel, many mitts are made of hard leather to provide a protective cushion between the player's hand and the incoming ball. Frequently, after purchasing a new leather mitt, however, the player will desire to condition, or break in, the mitt to make it feel and/or appear like it has been previously used. Two typical goals of conditioning a mitt are the softening of the leather and the formation of the baseball/softball pocket inside the portion of the mitt that receives the incoming ball.

One common approach to forming the pocket in a glove is to place a ball into the glove proximate a desired location for a baseball pocket, such as between the thumb and forefinger, and tie straps or bands around the exterior of the glove to ensure that it is tightly pressed around the ball. After several hours, or possibly even days, the leather proximate the ball may become loose and/or stretched, thereby forming the baseball pocket. One problem with this approach, however, is the need for straps and/or bands which, without being coupled to a ball, may easily be lost or misplaced. Therefore, there presently exists a need for a device that incorporates both a ball and straps to aid in the conditioning of a glove, namely in the formation of a baseball pocket.

BRIEF SUMMARY

In accordance with various example embodiments of the present general inventive concept, a device to aid in conditioning a baseball glove may include one or more balls; two or more looped straps; a means for coupling the two or more looped straps to the one or more balls; and whereby the one or more balls are placed in a baseball glove proximate a desired location for a baseball pocket, the two or more looped straps are fed through a slot in the glove and wrapped around the exterior of the glove to secure the one or more balls tightly therein.

In some embodiments, the device may further include a panel member provided to each of the two or more looped straps to aid in inserting the straps through the slot, the panel member including a location for identifying indicia.

In some embodiments, the panel member further includes a mating means such that each panel member may be mated to another panel member.

In some embodiments, the means for coupling the two or more looped straps to the one or more balls includes a coupling member inserted into the interiors of the one or more balls, the coupling member having an eyelet on one end through which the two or more looped straps are disposed.

In some embodiments, the means for coupling the two or more looped straps to the one or more balls includes an internal diametral cavity provided to the one or more balls through which the two or more looped straps are provided, the two or more looped straps provided with a stopping member proximate one end of the cavity to prevent the two or more looped straps from being pulled through the cavity.

In some embodiments, the device further includes a means for adjusting the two or more looped straps.

In some embodiments, two balls are coupled together by a coupling means.

In some embodiments, the means for coupling the two balls together includes a two-sided screw inserted into each ball.

In some embodiments, the two-sided screw is the means for coupling the two or more looped straps to the two balls.

In some embodiments, the means for coupling the two or more looped straps to the one or more balls includes at least one strap disposed through an internal diametral cavity provided to the one or more balls, the at least one strap coupled to the two or more looped straps proximate a first end of the cavity, the at least one strap provided with a stopping member proximate a second end of the cavity to prevent the at least one strap from being pulled back through the cavity.

In some embodiments, the means for coupling the two or more looped straps to the one or more balls is disposed substantially contiguous to the glove when the looped straps are wrapped around the exterior of the glove.

In accordance with various example embodiments of the present general inventive concept, a method of conditioning a baseball mitt may include providing a ball having at least two looped straps coupled thereto; placing the ball inside a baseball mitt proximate a desired location for a baseball pocket; inserting the at least two looped straps through a slot in the mitt, the inserted at least two looped straps being received on an exterior side of the mitt; looping each of the at least two looped straps around the mitt such that the ball is tightly secured within the mitt; and storing the mitt for a selected duration until the desired baseball pocket is formed.

In some embodiments, the looping operation includes separating the at least two looped straps around the mitt such that at least a portion of a first looped strap is wrapped around the mitt on one side of the ball and at least a portion of a second looped strap is wrapped around the mitt on another side of the ball.

In some embodiments, the method further includes the operation of adjusting the strap lengths.

In some embodiments, the adjusting operating occurs after the looping operation, in order to apply a desired amount of pressure to desired areas of the glove.

In accordance with various example embodiments of the present general inventive concept, a method of making a device for conditioning a glove may include providing at least one ball; providing at least two looped straps; and coupling the at least two looped straps to the ball such that the straps are to be inserted through a slot in the glove, the straps are received on an exterior side of the glove, and the straps are wrapped around the glove with the ball remaining therein.

In some embodiments, the coupling operation includes providing a coupling member having an eyelet; inserting a portion of the coupling member into the interior of the ball; and threading the at least two looped straps through the eyelet.

In some embodiments, the coupling operation includes providing an internal diametral cavity to the ball; inserting a first set of at least one strap through the cavity; providing a stopping means to the first set of at least one strap proximate a first end of the cavity to prevent the first set of at least one strap from being pulled back through the cavity; and coupling a second set of two looped straps to the first set of at least one strap proximate a second end of the cavity.

In some embodiments, the method further includes coupling a panel member having a location for identifying indicia to each of the at least two looped straps; and providing a means for mating each of the panel members.

Additional aspects and advantages of the present general inventive concept will be set forth in part in the description which follows, and, in part, will be obvious from the description, or may be learned by practice of the present general inventive concept.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Reference will now be made to various example embodiments of the present general inventive concept, examples of which are illustrated in the accompanying drawings and illustrations. The example embodiments are described herein in order to explain the present general inventive concept by referring to the figures. The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art.

In accordance with various example embodiments of the present general inventive concept, a device for conditioning a glove, namely to aid in the formation and/or maintenance of the baseball pocket, may include at least one ball provided with a plurality of straps. In some embodiments, the device may be placed inside the glove at the desired location for the baseball pocket, such as the webbing and/or palm region of the baseball glove, and the straps may be inserted into a slot interposing the interior and exterior of the glove, such as between two fingers of the glove. It will be noted that the example embodiments of the present general inventive concept may be placed in any area of almost any type of baseball glove, with the straps being fed through any slot of the baseball glove. The straps may then be wrapped around the exterior of the glove to tightly secure the glove around the ball. The present general inventive concept, therefore, has applicability in creating a baseball pocket during the break-in period of glove ownership, as well as maintaining the pocket in the glove thereafter. Additionally, the present general inventive concept provides a quick and convenient solution for conditioning a baseball glove in a one-piece device that can be easily located within an equipment bag.

While the example embodiments of the present general inventive concept discussed herein generally refer to baseball or baseball equipment (e.g., a baseball glove), for the sake of reference in the present application, "baseball" shall refer to both baseball and/or softball unless specified otherwise.

Figure 1:
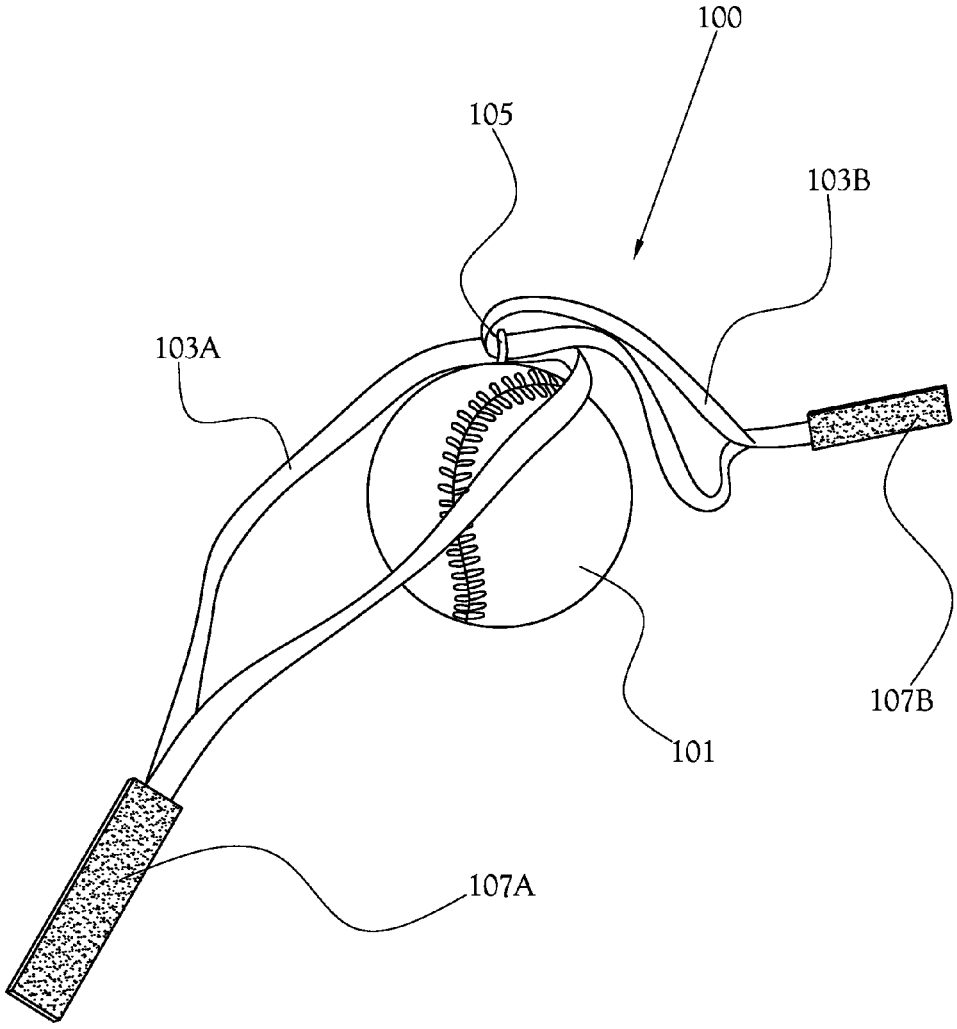
FIG. 1 illustrates an example embodiment device for conditioning a glove having two looped straps threaded through a coupling member that has been provided to a baseball.

FIG. 1 illustrates an example embodiment device for conditioning a glove 100 having two looped straps provided to a baseball by a coupling means.

An otherwise conventional baseball 101 has been provided with a coupling member 105 adapted to receive straps 103A and 103B. One of skill in the art will recognize that the present general inventive concept is not limited to use of a baseball. Accordingly, other objects including but not limited to softballs, tennis balls, and other articles generally shaped as spheres or pockets may be incorporated without departing from the scope or spirit of the present general inventive concept. For the sake of reference in the present application, "ball" will refer to any spherical or pocket-shaped object.

Still referring to FIG. 1, the coupling member 105 provided to the baseball may be an elongated screw with an eyelet on one end. The screw end of the coupling member 105 has been inserted into the baseball 101. One of skill in the art will recognize that the coupling member 105 may be provided to the baseball 101 in any number of ways without departing from the scope or spirit of the present general inventive concept. For example, the coupling member 105 may be provided to the baseball 101 by use of adhesive, or the coupling member 105 may be integrally formed with the baseball 101.

In the example embodiment illustrated in FIG. 1, two looped straps 103A and 103B have been inserted through the eyelet portion of the coupling member 105. In some embodiments, the looped straps span a length of 200 mm-250 mm, with a width of approximately 10 mm, and a thickness of about 1.5 mm-3 mm. In some embodiments, the looped straps are nylon and/or exhibit elastic properties. In other embodiments, the looped straps are a non-elastic material. One of skill in the art will recognize that the non-elastic straps may have applicability in embodiments where child safety is of concern. One of skill in the art will also recognize that numerous materials known in the art may be used as straps without departing from the scope or spirit of the present general inventive concept. Furthermore, various other dimensions may be incorporated without departing from the scope or spirit of the present general inventive concept.

Still referring to FIG. 1, each looped strap 103A and 103B may be provided at one end with a panel member 107A and 107B, as illustrated in FIG. 1. In some embodiments, the panel members 107A and 107B are semi rigid and include a location for name and/or team indicia to be provided. In some embodiments, the panel members 107A and 107B include a mating means, such as complementary hook and pile segments (e.g., Velcro), in order to facilitate the panel members 107A and 107B mating with one another (discussed further below).

Figure 2A:
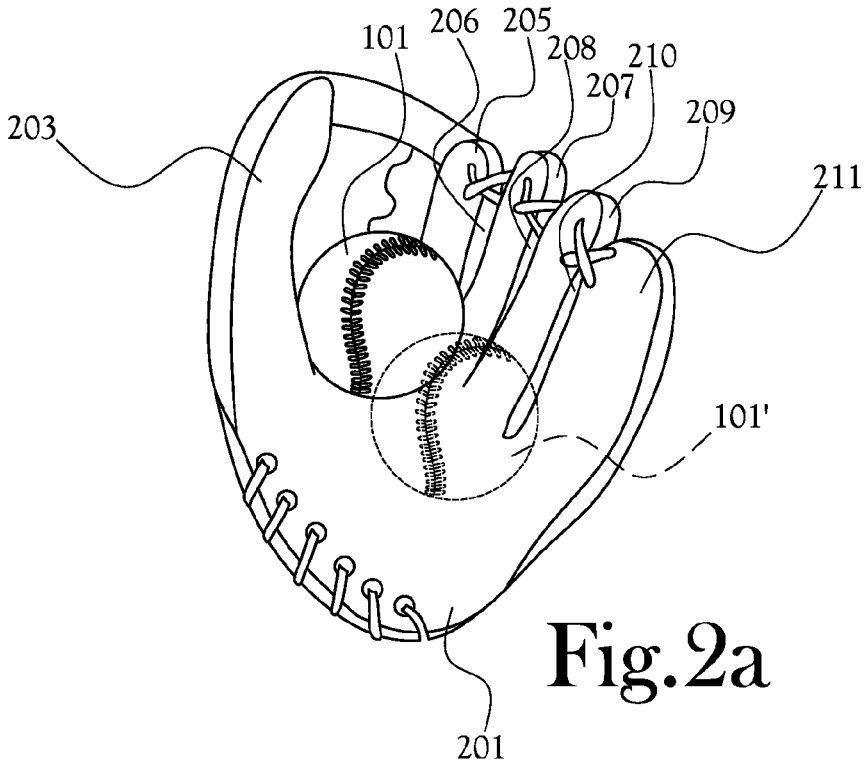
FIG. 2*a* illustrates the example embodiment device of FIG. 1 placed inside a baseball glove proximate a desired location for the baseball pocket.

FIG. 2*a* illustrates the example embodiment device of FIG. 1 placed inside a baseball glove proximate the desired location of the baseball pocket. The device 100 has been positioned in the baseball glove 201 proximate the desired location of the baseball pocket, namely in the webbing of the glove between the thumb 203 and the forefinger 205. As illustrated, the baseball 101' may also be placed in other positions inside the glove, as desired. The straps 103A and 103B may be inserted through a slot in the glove to engage the exterior of the glove. Stated differently, the straps 103A and 103B may be inserted through the slot 206 interposing the forefinger 205 and middle finger 207 (as illustrated), the slot 208 interposing the middle finger 207 and ring finger 209, the slot 210 interposing the ring finger 209 and little finger 211, and/or any other slot leading to the glove's exterior in order to be exposed to the exterior of the baseball glove 201.

Figure 2B:
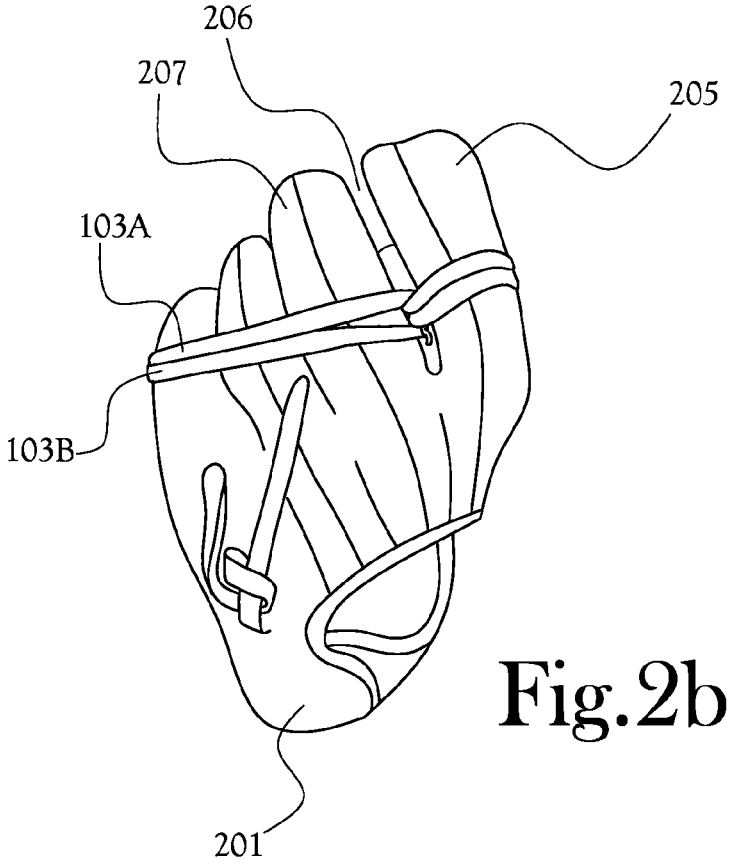
FIGS. 2*b-d* illustrate the example embodiment device of FIG. 1 having been placed inside the glove, with the straps wrapped around the exterior of the baseball glove in various configurations.
Figure 2C:
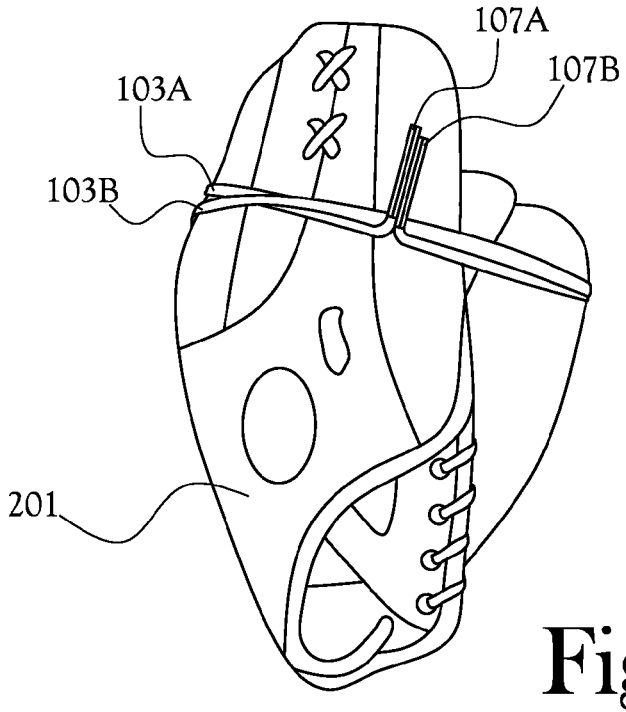

FIGS. 2*b* and 2*c* illustrate side views of the baseball glove 201 having the example embodiment device of FIG. 1 contained therein. As illustrated in FIG. 2*b*, the straps 103A and 103B have been received through the slot 206 interposing the forefinger 205 and middle finger 207, and wrapped around the exterior of the glove 201 to tightly secure it around the ball 101. Thus, the means for coupling the straps 103A and 103B to the ball may become substantially contiguous to the glove 201 as the ball 101 is forced deeper into the glove 201 by virtue of the straps 103A and 103B being pulled through and wrapped around the glove 201.

The panel members 107A and 107B that have been provided to each looped strap 103A and 103B aid in the threading of the straps 103A and 103B through the finger slot 206 by narrowing the looped straps 103A and 103B and providing a semi-rigid member to facilitate insertion through the slot 206. As illustrated in FIG. 2*c*, the panel members 107A and 107B of each strap 103A and 103B have been removably mated together. In the illustrated embodiment, Velcro is used to mate the panel members 107A and 107B together. However, one of skill in the art will recognize that the present general inventive concept is not limited to using Velcro; other mating means including but not limited to magnets, snaps, etc., may be incorporated and/or used without departing from the scope or spirit of the present general inventive concept.

Figure 2D:
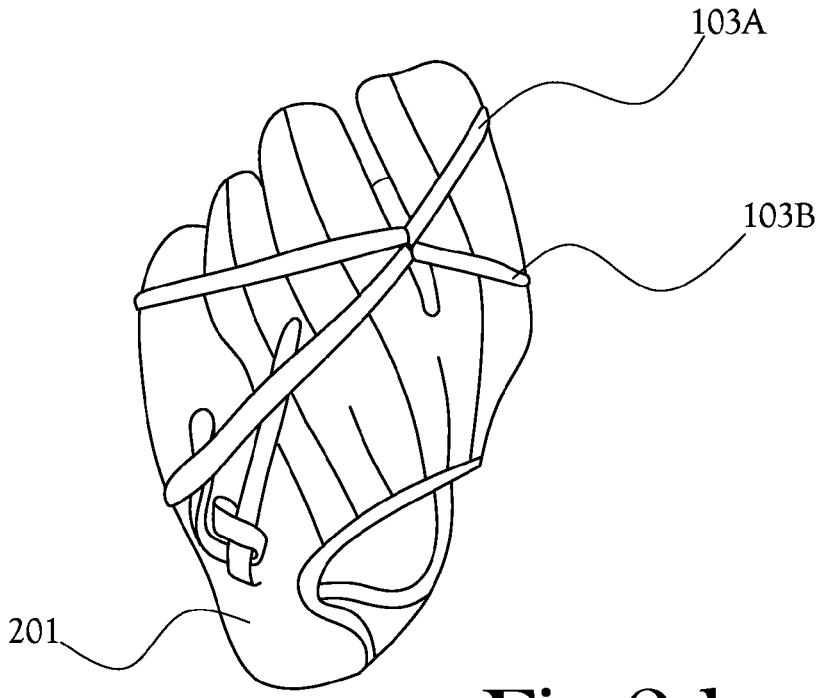

FIG. 2*d* illustrates another side view of the baseball glove 201 having the example embodiment device of FIG. 1 contained therein, with the straps 103A and 103B being wrapped around the exterior of the glove 201 in a criss-cross pattern. Stated differently, the straps 103A and 103B have been received through one of the slots interposing the fingers, and then wrapped around the glove 201 such that the loops of each strap 103A and 103B are spread apart, thereby forming a criss-cross pattern on the exterior of the glove 201. It will be noted that the criss-crossed straps engage a wider area of the glove 201 than do non-criss-crossed straps and distribute pressure on both sides of the ball 101 (not shown). Accordingly, those of skill in the art will recognize that some individuals may prefer criss-crossed straps due the wider distribution of pressure along the glove's exterior.

Figure 2E:
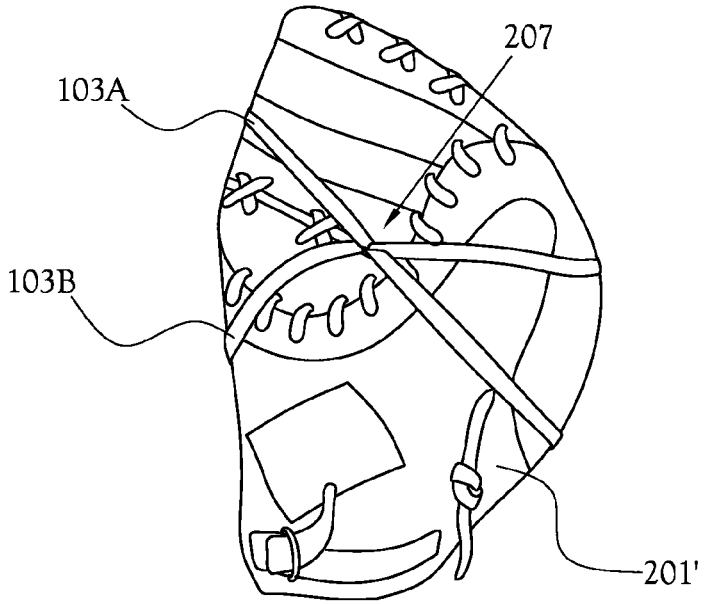
FIGS. 2*e-f* illustrate opposing side views of the example embodiment device of FIG. 1 having been placed inside a catcher's glove, with the straps threaded through a slot in the webbing and wrapped around the exterior of the glove.
Figure 2F:
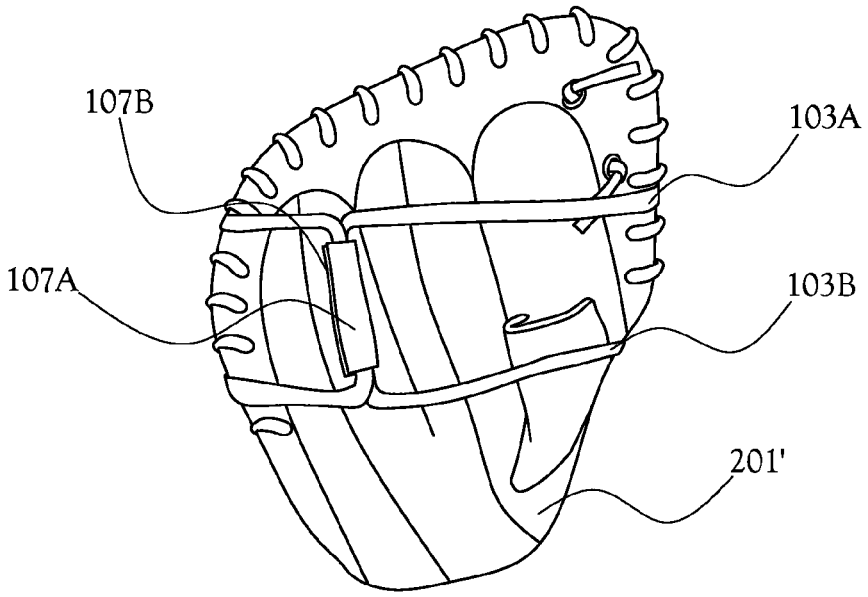

FIGS. 2*e-f* illustrate opposing side views of the example embodiment device 100 of FIG. 1 placed inside a catcher's mitt 201', with the two looped straps 103A and 103B having been inserted through a slot 207 in the webbing of the mitt 201' and wrapped around the exterior of the mitt 201'. One of skill in the art will recognize that not all baseball gloves contain slots interposing fingers, such as the glove illustrated in FIGS. 2*a-d*. Frequently, catcher's mitts and first-basemen mitts will not have interposing finger slots. Therefore, the present general inventive concept is adapted to accommodate these gloves by inserting the two looped straps 103A and 103B through a slot in the webbing of the glove 201'. Alternatively, the straps 103A and 103B may also be inserted through slots adjacent the webbing. The present general inventive concept is therefore not limited to straps inserted through any specific slot in the glove.

Figure 3A:
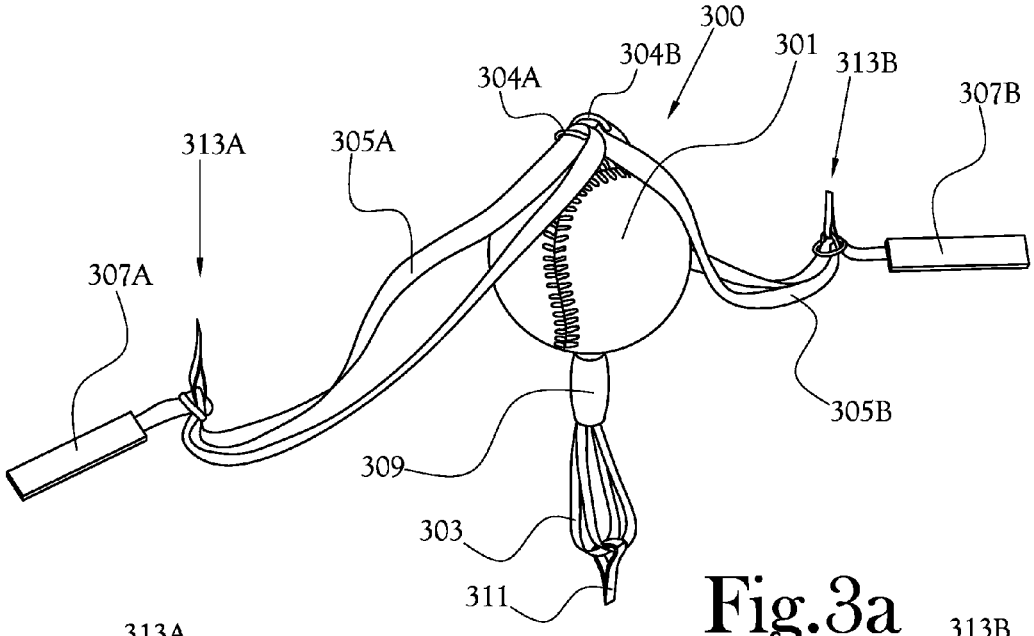
FIG. 3*a* illustrates another example embodiment device for conditioning a glove having a first looped strap threaded through a ball and coupled to a second set of looped straps, with various adjustment means provided for adjusting the length of the straps.
Figure 3B:
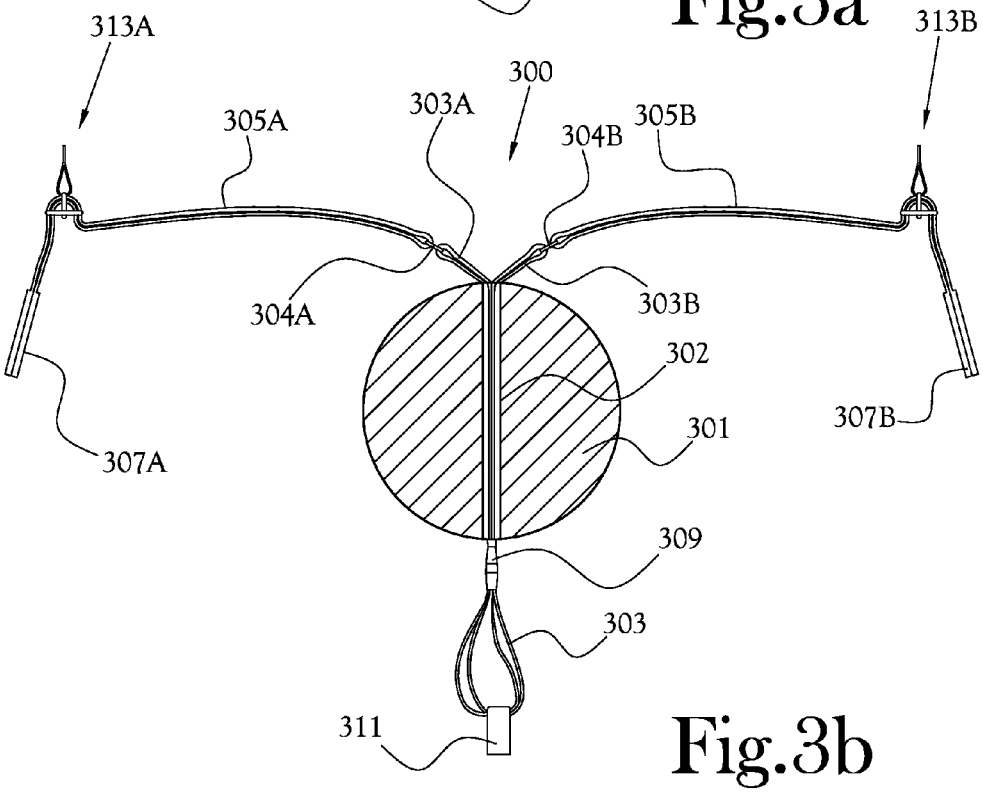
FIG. 3*b* illustrates a cross-sectional view of the example embodiment device of FIG. 3*a;*

FIG. 3*a* illustrates another example embodiment device for conditioning a glove 300 having a first looped straps threaded through a ball and coupled to two more looped straps for wrapping around the glove. Various adjustment members coupled to the straps for adjusting the length of the straps are also provided. FIG. 3*b* illustrates a cross-sectional view of the example embodiment device 300 illustrated in FIG. 3*a*.

In the illustrated example embodiment, a ball 301 has been provided with an internal diametral cavity 302, through which a first looped strap 303 has been inserted. The first looped strap 303 has been folded over on top of itself and inserted into the cavity, thereby providing the appearance of two looped straps. Proximate one end of the cavity 302, the first looped strap 303 has been coupled to a second set of looped straps 305A and 305B using two pivoting rings 304A and 304B. In some embodiments, the looped straps 303 and 305A/B are approximately 200 mm in length. One of skill in the art will recognize that these example dimensions are non-limiting.

In some unillustrated embodiments, the device includes two sets of looped straps: a first set of two looped straps to be threaded through the cavity 302 and a second set of two looped straps coupled to the first set straps for wrapping around the exterior of the glove. One of skill in the art will recognize that using a first set of two looped straps inserted through the ball's cavity provides similar functionality as using a single folded, first looped strap.

In the example embodiment illustrated in FIGS. 3*a-b*, the first looped strap 303 has been provided with a stopping member 309 proximate the end of the cavity 302 opposite the pivoting rings 304. In the illustrated embodiment, the stopping member 309 is a barrel plug. Stated differently, the stopping member 309 is a toroidal shaped member through which the first strap 303 may be provided. In some embodiments, the internal surface is such that a substantial amount of friction is present between the first strap 303 and the barrel plug 309, thereby providing a selective adjustment means for the first strap 303. A pull tab 311 may be provided to the first strap 303, thereby preventing the first strap 303 from being pulled through the barrel plug 309.

Figure 3C:
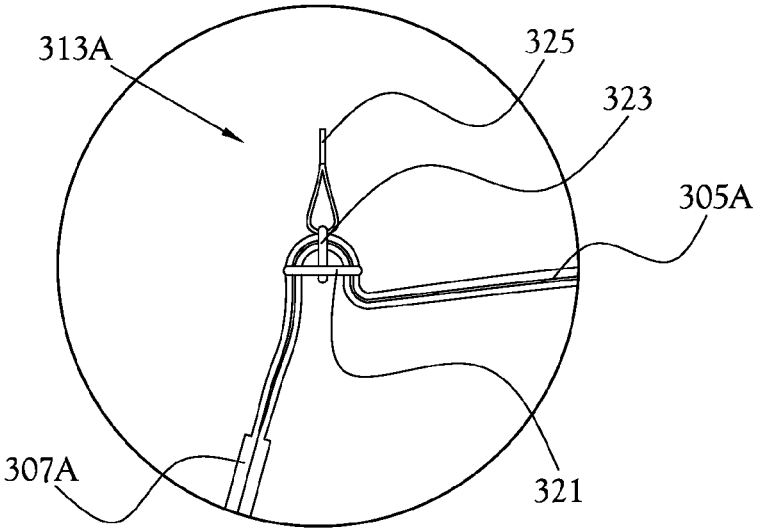
FIG. 3*c* illustrates a close-up view of an adjustment means provided to the example embodiment device of FIG. 3*a;*

The second set straps 305A and 305B have also been provided with adjustment means, depicted at 313A and 313B, that interpose the pivoting rings 304A and 304B and panel members 307A and 307B. FIG. 3*c* illustrates a close-up view of the adjustment means 313A of the example embodiment device 300 of FIG. 3*a*.

Referring to FIG. 3*c*, two ring members 321 and 323 have been provided perpendicular to one another. Stated differently, a first circular ring 321 is provided substantially horizontally, through which a second set looped strap 305A is inserted. In the illustrated embodiment, the second set looped strap 305A has been inserted vertically upwards through the ring. A second circular ring 323 has also been provided substantially vertically at the substantial middle of the first horizontal circular ring 321. The second set looped strap 305A has been inserted through the second circular ring 323, and then turned vertically downwards and inserted back through the first circular ring 321. One of skill in the art will recognize that the perpendicular circular rings 321 and 323 provide an adjustment means for the second set looped strap 305A. One of skill in the art will also recognize that the present general inventive concept is not limited to an adjustment means comprised of two circular rings. Accordingly, various other means known in the art may be provided to adjust the length of the straps without departing from the scope or spirit of the present general inventive concept.

In embodiments bearing the adjustment means 313A and 313B, the panel members 307A and 307B may be mated together after the second set looped straps 305A and 305B have been wrapped around the exterior of a baseball glove, without affecting the tightness of the second set looped straps 305A and 305B. Stated differently, the second set looped straps 305A and 305B may be wrapped around the exterior of a baseball glove and the panel members 307A and 307B may be mated together at a convenient mating location relative the glove. The adjustment means 313A and 313B may then be selectively modified to achieve the desired amount of pressure for the second set looped straps 305A and 305B, notwithstanding the convenient mating location for the panel members 307A and 307B.

Figure 4A:
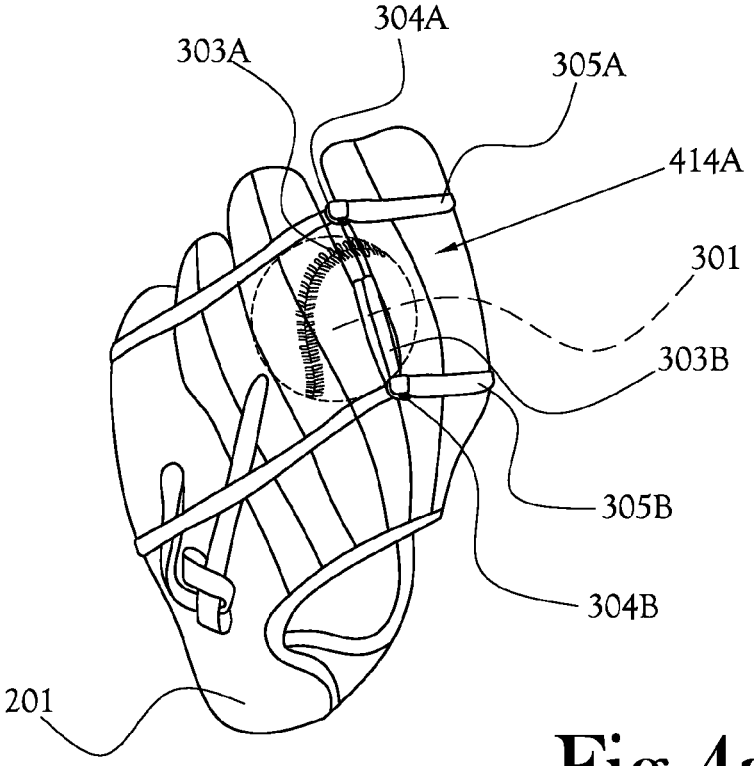
FIGS. 4*a-b* illustrate opposing side views of the example embodiment device of FIGS. 3*a-c* having been placed inside the glove, with the straps wrapped around the exterior of the glove on opposing sides of the ball contained therein.
Figure 4B:
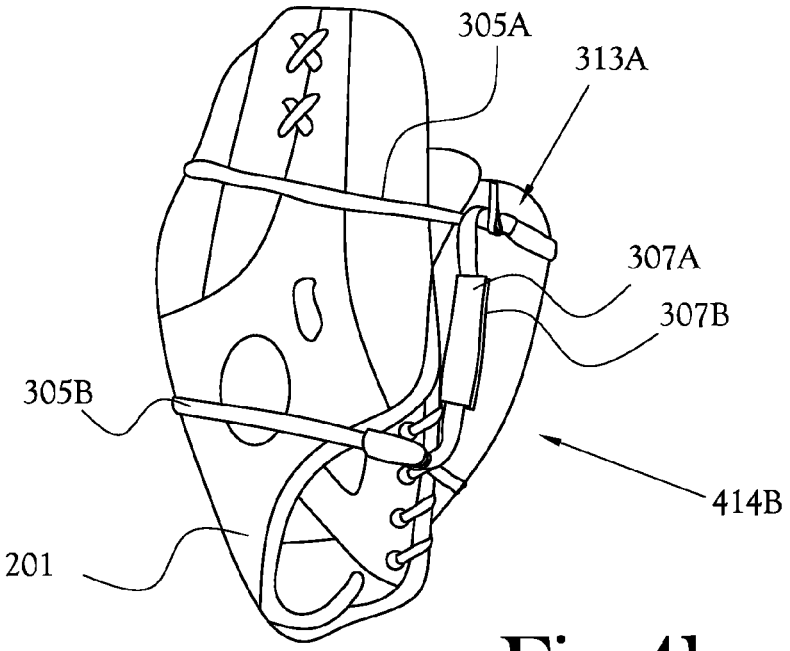

FIGS. 4*a-b* illustrate opposing side views of the example embodiment device 300 of FIG. 3 having been placed inside the glove, with the straps wrapped around the exterior of the glove to form two I-shaped configurations. FIG. 4*a* depicts the first folded, looped strap 303 emerging through a slot of the glove 201, with the ends 303A and 303B diverging in opposite directions. One end 303A of the first looped strap 303 has been directed toward the top of the glove 201, above the baseball 301. The other end 303B has been directed toward the bottom of the glove 201, below the ball 301. Thus, the straps may be configured to wrap around the glove in such a manner as to distribute pressure on both sides of the ball.

Referring to FIGS. 4*a-b*, two I-shaped configurations of the straps are depicted at 414A and 414B. The first I-shaped configurations 414A is the result of the first folded looped strap ends 303A and 303B diverging in opposite directions and the second set of looped straps 305A and 305B being wrapped around the glove so as to appear substantially perpendicular to the diverging ends 303A and 303B of the first looped strap 303. The second I-shaped configuration 414B is the result of the panel members 307A and 307B being mated in a substantially perpendicular manner relative the second set looped straps 305A and 305B that have been wrapped around the glove 201.

Figure 5:
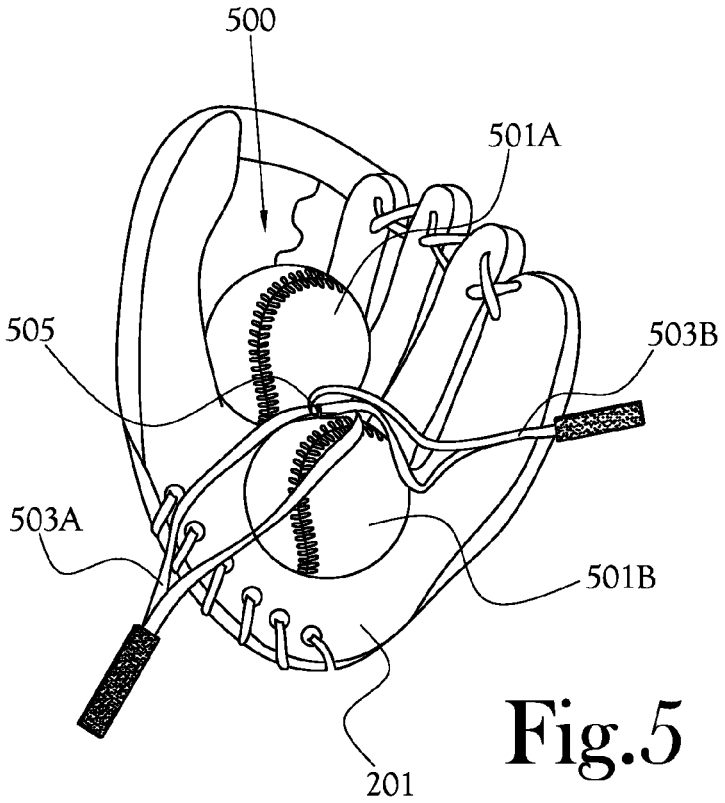
FIG. 5 illustrates yet another example embodiment device for conditioning a glove having two balls coupled together and two looped straps extending from the coupling point to wrap around the exterior of the glove.

FIG. 5 illustrates yet another example embodiment device for conditioning a glove 500 having two balls coupled together and two looped straps extending from the coupling point to wrap around the exterior of the glove. The two balls 501A and 501B have been coupled together using a coupling means and placed inside the baseball glove 201. In some embodiments, the coupling means includes a two-sided screw that is inserted into each ball 501A and 501B, such that they are joined to the extent that surfaces of each ball 501A and 501B are in contact with or at least substantially close to one another. In some embodiments a length of only a few millimeters separates the surfaces of each ball 501A and 501B, as illustrated in FIG. 5. A coupling point 505, or the portion of the screw left exposed between the two balls 501A and 501B, is also depicted and provides a means to couple the two looped straps 503A and 503B to the two balls 501A and 501B. One of skill in the art will recognize that the coupling means is not limited to a two-sided screw. Other means, including but not limited to adhesives, a pouch, or the like, may be used without departing from the scope or spirit of the present general inventive concept. Additionally, the two balls 501A and 501B may be integrally formed with a depressed region interposing the two spherical regions to provide a location to couple the two looped straps 503A and 503B.

One of skill in the art will recognize that embodiments having two balls offer certain advantages over one-ball embodiments, namely the ability to condition different parts of the glove simultaneously. Stated differently, some individuals prefer having multiple baseball pockets within their glove, such as a pocket in the webbing of the glove, between the thumb and forefinger, as well as a pocket in the palm region of the glove. The embodiment illustrated in FIG. 5 enables players to condition multiple baseball pockets simultaneously.

In accordance with the foregoing discussion, the present general inventive concept has applicability in conditioning a baseball glove beginning on the date of purchase of the glove, all the way through the life of the glove until its retirement. Namely, the present general inventive concept includes a device used to aid in the formation and/or maintenance of a baseball pocket within the glove (also referred to as "breaking in the glove"). More particularly, the device enables users to form and/or maintain a customized baseball pocket in the interior of the baseball glove, thereby improving the functionality of the baseball glove. The device may be positioned within the glove at any desired location for the baseball pocket. Some individuals may prefer the baseball pocket to be located substantially within the webbing of the glove (e.g., outfielders). Alternatively, others may prefer the baseball pocket to be positioned substantially within the palm area of the baseball glove (e.g., infielders). The example embodiment devices disclosed herein accommodates any desired position for the baseball pocket, thereby permitting individuals to customize their gloves accordingly.

It will be recognized by those of skill in the art that the present general inventive concept provides numerous advantages over the prior art. For instance, the inclusion of multiple looped straps enables users to distribute pressure to multiple locations and/or different portions on the exterior of the baseball glove. Namely, the multiple looped straps may be positioned on either side of the baseball contained within the glove, thereby providing an efficient means to form the baseball pocket in the glove. Further, because the straps may be pulled through a slot of the glove interposing its interior and exterior sides, the ball is pulled deeper into the glove at the desired location for the baseball pocket when the straps are tightened around the glove. It will be noted that in some embodiments, the frictional forces between the glove and the ball positioned in the desired location for the baseball pocket will substantially prevent movement of the ball, even with the straps tightly wrapped around the exterior of the glove. Thus, in those embodiments, the forces initiated by pulling the straps through the glove and wrapping them around the glove will force the ball deeper into the desired location for the baseball pocket, whether that location is proximate the palm area or the webbing of the glove.

Additionally, some embodiments of the present general inventive concept provide for a means to adjust the strap lengths, and thereby adjust the amount of pressure being applied to the glove. Panel members may also be provided to the straps with a location for identifying indicia, such as a player's name or team. The panel members may also include a mating means to mate the panel members together for conveniently storing the glove and the device.

The present general inventive concept may also include a method of conditioning a baseball mitt. In some embodiments, the method includes the operations of providing a ball having at least two looped straps coupled thereto, placing the ball inside a baseball mitt proximate a desired location for a baseball pocket, inserting the looped straps through a slot in the mitt so that the inserted straps are received on an exterior side of the mitt, looping each strap around the mitt to tightly secure the ball within the mitt, and storing the mitt for a selected duration until the desired baseball pocket is formed. In some embodiments, the looping operation includes separating the straps around the mitt such that at least a portion of a first looped strap is wrapped around the mitt on one side of the ball and at least a portion of a second looped strap is wrapped around the mitt on another side of the ball. In some embodiments, the method may further include the operation of adjusting the strap lengths, which may occur after the straps have been looped around the glove, in order to apply a desired amount of pressure to the glove. One of skill in the art will understand that a selected duration may range from a few hours, to a few days, or even longer in order to allow the mitt to loosen and/or stretch in the appropriate areas to accommodate formation and/or maintenance of the baseball pocket.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

While the present general inventive concept has been illustrated by description of several example embodiments, it is not the intention of the applicant to restrict or in any way limit the scope of the inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings.

The invention claimed is:

1. A device to aid in conditioning a baseball glove having at least one through slot interposing an interior and an exterior of the glove, said device comprising:

one or more balls;

two or more looped straps;

a means for coupling the two or more looped straps to the one or more balls, wherein the means for coupling the two or more looped straps to the one or more balls includes an internal diametral cavity provided to the one or more balls through which the two or more looped straps are provided, the two or more looped straps provided with a stopping member proximate one end of the cavity to prevent the two or more looped straps from being pulled through the cavity; and whereby the one or more balls are placed in a baseball glove proximate a desired location for a baseball pocket, the two or more looped straps are fed through a slot and wrapped around the exterior of the glove to secure the one or more balls tightly therein.

2. A device to aid in conditioning a baseball glove having at least one through slot interposing an interior and an exterior of the glove, said device comprising:

one or more balls;

two or more looped straps;

a means for coupling the two or more looped straps to the one or more balls, wherein the means for coupling the two or more looped straps to the one or more balls includes at least one strap disposed through an internal diametral cavity provided to the one or more balls, the at least one strap coupled to the two or more looped straps proximate a first end of the cavity, the at least one strap provided with a stopping member proximate a second end of the cavity to prevent the at least one strap from being pulled back through the cavity; and whereby the one or more balls are placed in a baseball glove proximate a desired location for a baseball pocket, the two or more looped straps are fed through a slot and wrapped around the exterior of the glove to secure the one or more balls tightly therein.

3. A method of making a device for conditioning a glove, the method comprising:

providing at least one ball;

providing at least two looped straps; and coupling the at least two looped straps to the ball such that the straps are to be inserted through a slot in the glove, the straps are received on an exterior side of the glove, and the straps are wrapped around the glove with the ball remaining therein;

wherein the coupling operation includes:

providing an internal diametral cavity to the ball;

inserting a first set of at least one strap through the cavity;

providing a stopping means to the first set of at least one strap proximate a first end of the cavity to prevent the first set of at least one strap from being pulled back through the cavity, and coupling a second set of two looped straps to the first set of at least one strap proximate a second end of the cavity.

4. A device to aid in conditioning and maintaining a pocket of a baseball glove having at least one through slot interposing an interior and an exterior of the glove, said device comprising:

one or more balls;

two or more looped straps respectively provided with a semi-rigid member at an end thereof configured to be inserted through the at least one through slot;

a means for coupling the two or more looped straps to the one or more balls, wherein the means for coupling the two or more looped straps to the one or more balls includes an internal diametral cavity provided to the one or more balls through which the two or more looped straps are provided, the two or more looped straps provided with a stopping member proximate one end of the cavity to prevent the two or more looped straps from being pulled through the cavity; and whereby the one or more balls are placed in a baseball glove proximate a desired location for a baseball pocket, the two or more looped straps are fed through the at least one through slot and wrapped around the exterior of the glove to secure the one or more balls tightly therein.

5. A device to aid in conditioning and maintaining a pocket of a baseball glove having at least one through slot interposing an interior and an exterior of the glove, said device comprising:

one or more balls;

two or more looped straps respectively provided with a semi-rigid member at an end thereof configured to be inserted through the at least one through slot;

a means for coupling the two or more looped straps to the one or more balls, wherein the means for coupling the two or more looped straps to the one or more balls includes at least one strap disposed through an internal diametral cavity provided to the one or more balls, the at least one strap coupled to the two or more looped straps proximate a first end of the cavity, the at least one strap provided with a stopping member proximate a second end of the cavity to prevent the at least one strap from being pulled back through the cavity; and whereby the one or more balls are placed in a baseball glove proximate a desired location for a baseball pocket, the two or more looped straps are fed through the at least one through slot and wrapped around the exterior of the glove to secure the one or more balls tightly therein.

6. A method of making a device for conditioning and maintaining a pocket of a glove, the method comprising:

providing at least one ball;

providing at least two looped straps;

providing a semi-rigid member, configured to be inserted through a slot in the glove, at an end of each of the respective looped straps; and coupling the at least two looped straps to the ball such that the straps are to be inserted from an inner face of the glove through a slot in the glove that is proximate to a desired location of a pocket, the straps are received on an exterior side of the glove, and the straps are wrapped around the glove with the at least one ball remaining firmly embedded and secured within the desired location of the pocket;

wherein the coupling operation includes:

providing an internal diametral cavity to the ball, inserting a first set of at least one strap through the cavity, providing a stopping means to the first set of at least one strap proximate a first end of the cavity to prevent the first set of at least one strap from being pulled back through the cavity, and coupling a second set of two looped straps to the first set of at least one strap proximate a second end of the cavity.

* * * * *